US006741155B2

(12) United States Patent
Usui

(10) Patent No.: US 6,741,155 B2
(45) Date of Patent: May 25, 2004

(54) TRANSFORMER

(75) Inventor: Hiroshi Usui, Saitama (JP)

(73) Assignee: Sanken Electric Co., Ltd., Saitama (JP)

( * ) Notice: Subject to any disclaimer, the term of this patent is extended or adjusted under 35 U.S.C. 154(b) by 84 days.

(21) Appl. No.: 10/145,318

(22) Filed: May 14, 2002

(65) Prior Publication Data

US 2002/0167388 A1 Nov. 14, 2002

(30) Foreign Application Priority Data

May 14, 2001 (JP) ..... 2001-143924

(51) Int. Cl.[7] ..... H01F 5/00

(52) U.S. Cl. ..... 336/200; 336/223; 336/232; 336/212

(58) Field of Search ..... 336/212, 200, 336/223, 232, 83; 29/602.1, 606, 604; 257/531

(56) References Cited

U.S. PATENT DOCUMENTS

| | | | | |
|---|---|---|---|---|
| 5,565,837 A | * | 10/1996 | Godek et al. | 336/232 |
| 5,631,822 A | * | 5/1997 | Silberkleit et al. | 363/144 |
| 5,929,733 A | * | 7/1999 | Anzawa et al. | 336/61 |
| 5,952,909 A | * | 9/1999 | Umeno et al. | 336/192 |
| 6,147,583 A | * | 11/2000 | Rinne et al. | 336/200 |
| 6,239,683 B1 | * | 5/2001 | Roessler et al. | 336/200 |
| 6,281,779 B1 | * | 8/2001 | Matsumoto et al. | 336/200 |

* cited by examiner

*Primary Examiner*—Anh Mai
(74) *Attorney, Agent, or Firm*—Howard & Howard

(57) ABSTRACT

A transformer comprises E-type core parts, a cylindrical core part, a second substrate, first substrates, and an insulating sheet. Each of the second substrate and the fist substrates includes a penetration hole. A coil is wired around the penetration hole. The second substrate is wrapped with an insulating sheet, together with the cylindrical core part. The second substrate and the cylindrical core part are sandwiched between cylindrical core legs of the core parts, through the insulating sheet.

12 Claims, 11 Drawing Sheets

TRANSFORMER

BACKGROUND OF THE INVENTION

1. Field of the Invention

The present invention relates to a transformer, which can ensure insulation and a sufficient creepage distance between a primary and a secondary winding.

2. Description of the Related Art

Sheet transformers comprise a core and primary and secondary printed wiring.

As shown in FIG. 10, the core comprises a pair of E-type core parts 51 and 52 which are formed in an "E" shape in their side view. The E-type core parts are combined together so as to form the core. The E-type core parts 51 and 52 include cylindrical core legs 51*a* and 52*a*, respectively, in the center thereof.

As shown in FIG. 11, the primary winding is formed on a substrate 53. The substrate 53 has a hole 53*a* through which the core legs 51*a* and 52*a* of the E-type core parts 51 and 52 penetrate and a winding which is printed on a surface of the printed wiring board 53.

This printed wiring board 53 is incorporated with the core legs 51*a* and 52*a* of the E-type core parts 51 and 52, thereby forming a sheet transformer. A part of the magnetic path is formed by the core legs 51*a* and 52*a*.

For transformers, there are a variety of safety standards of various countries. In accordance with the requirements of the standards, it is necessary to insulate between the primary winding (input coil) and the secondary winding (output coil).

Among international safety standard for transformers, IEC (International Electro-technical Commission) 950 is for office supplies, etc. IEC 950 restricts the thickness of an insulating material arranged between the primary and second windings and the creepage distance or a spatial distance between the primary and secondary windings, in accordance with the used voltage.

In the as described above, where the primary winding and the secondary winding are formed on different printed wiring boards, it is possible to ensure a predetermined thickness of an insulating paper between the printed wiring boards, but there is a difficult to ensure a predetermined creepage distance between the primary and secondary windings.

Thus, it is difficult to satisfy the safety standard for transformers. Therefore, the thin-type transformer can be used only for low-voltage power source, such as a DC-DC converter equal to or lower than 48V, etc. that does not seriously require the insulation.

SUMMARY OF THE INVENTION

The present invention has been made in consideration of the above. It is accordingly an object of the present invention to provide a transformer which has the structure for ensuring the insulation and the creepage distance between a first and second windings.

Another object thereof is to provide a transformer which safely operates with high reliability.

In order to attain the above objects, according to the first aspect of the present invention, there is provided a transformer comprising:

a first substrate which includes a first winding;

a second substrate which includes a second winding and an opening in center of the second winding;

an insulating material which covers the first substrate and insulates between the first winding and the second winding; and a core which has two ends holding the first substrate covered with the insulating material through the insulating material therebetween, and which forms a part of the magnetic path passing through the first winding and the second winding.

According to such a structure of the transformer, it is possible to ensure the insulation and a creepage distance between the first winding and the second winding.

The first substrate may include an opening in a center portion of the first winding and a core member arranged in the opening of the first substrate;

the insulating material may cover the first substrate including the core member; and the core may be so formed that the core member of the first substrate is sandwiched between the two ends through the insulating material.

The core and the core member may be to form a part of the magnetic path which passes through the first winding and the second winding.

The first substrate may include an opening in a center portion of the first winding; and the core may be so formed that the opening of the first substrate is sandwiched between the two ends through the insulating material.

The opening may form a gap of the magnetic path passing through the first winding and the second winding.

The core may include a first core leg and a second cored leg respectively forming a part of the magnetic path;

the first substrate may be sandwiched between the first and second core legs through the insulating material; and one of the first and second core legs may penetrate through the opening formed in said second winding of the second substrate.

Each of the first and second core legs may penetrate through the opening formed in said second winding of the second substrate.

Each of the first winding and the second winding may be formed from a sheet coil, and both of the first and second windings may be stacked up one after another;

the insulating material may comprise a sheet-like insulating material which covers over the first winding; and the first core leg and second core leg of the core may be so arranged that center of the first winding covered with the insulating material is sandwiched therebetween.

The second winding may comprise two sheet coils between which the first winding is arranged; and the transformer further may comprise a second insulating material which covers over at least one of the sheet coils constituting the second winding.

In order to attain the above objects, according to the second aspect of the present invention, there is provided a transformer comprising:

a first sheet coil;

a second sheet coil which is stacked on the first sheet coil and has mutual induction with the first sheet coil;

an insulating material which so covers over the first sheet coil as to insulate first and second sheet coils from each other and ensure a creepage distance between the first and second sheet coils; and a core which is so formed that the insulating material covering over the first sheet coil is sandwiched between the two ends thereof and which is to form a magnetic patch through the first and second sheet coil.

The core may be formed of ferrite.

A core member may be arranged in a center portion of the first sheet coil; and the core member and the core may be to form a magnetic path passing through center portions of the first and second sheet coils.

The center portion of the first sheet coil may have an opening; and the opening may serve as a gap of a part of the magnetic path formed by the core.

BRIEF DESCRIPTION OF THE DRAWINGS

These objects and other objects and advantages of the present invention will become more apparent upon reading of the following detailed description and the accompanying drawings in which.

DETAILED DESCRIPTION OF A PREFERRED EMBODIMENTS

Preferred embodiments of the present invention will now be described with reference to the accompanying drawings.

First Embodiment

Figure 1:
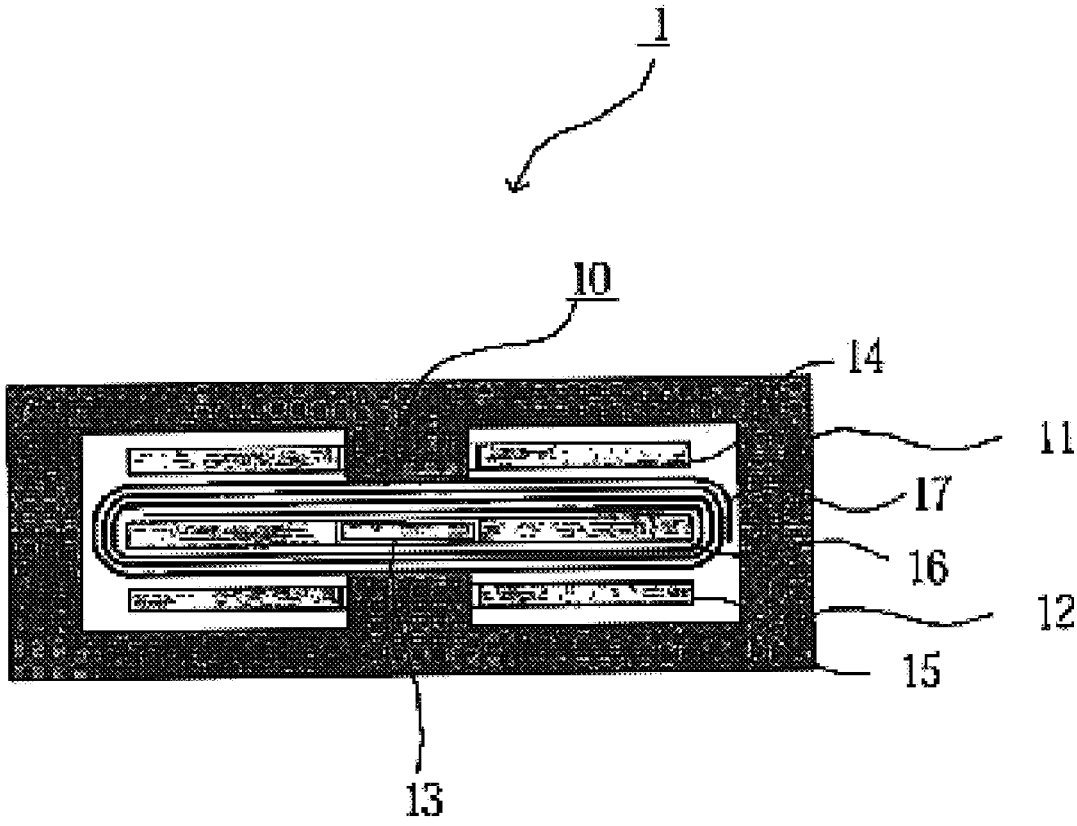
FIG. 1 is a cross sectional view showing the structure of a transformer according to the first embodiment of the present invention.

A transformer according to the first embodiment of the present invention comprises, as shown in FIG. 1, a core 10, first substrates 14 and 15, a second substrate 16 and an insulating sheet 17.

Figure 2:
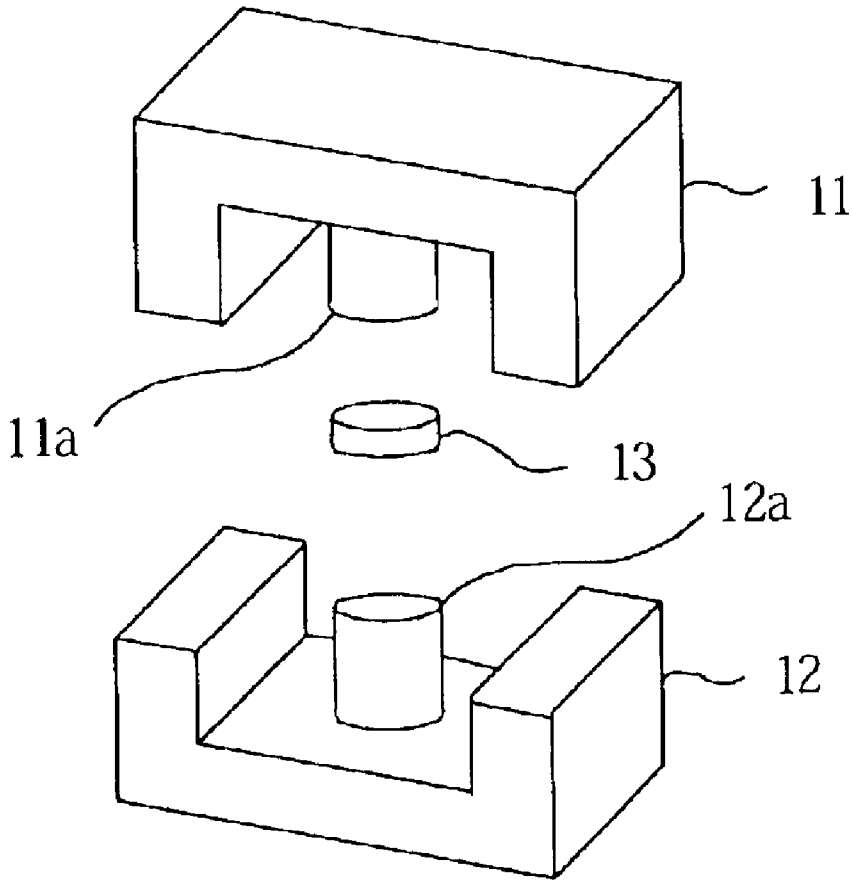
FIG. 2 is a perspective diagram showing the core used in the transformer of FIG. 1.

The core 10 is formed from magnetic materials, such as silicon steel sheet, ferrite, etc., and comprises E-type core parts 11 and 12 and a cylindrical core part 13, as shown in FIGS. 1 and 2.

Each of the E-type core parts 11 and 12 is formed in an "E" shape in its side view, has a rectangular cross section, and includes cylindrical core legs 11*a* and 12*a* in the center thereof. The cylindrical core part 13 has approximately the same thickness (height) as that of the second substrate 16 and approximately the same diameter as that of the core legs 11*a* and 12*a*.

Figure 3A:
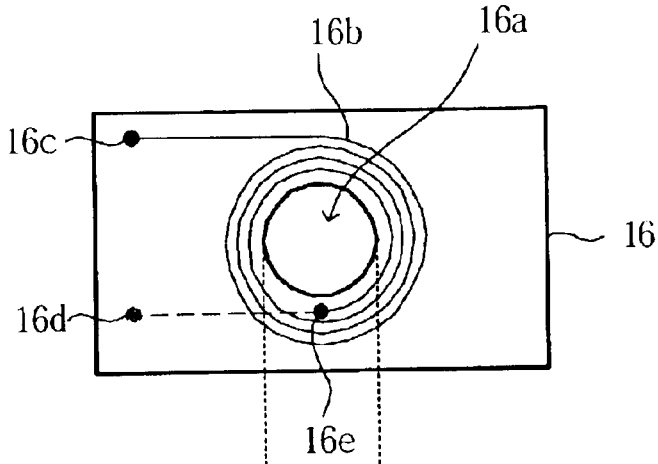
FIGS. 3A and 3B are diagrams each showing the structure of a second substrate shown in FIG. 1.
Figure 3B:
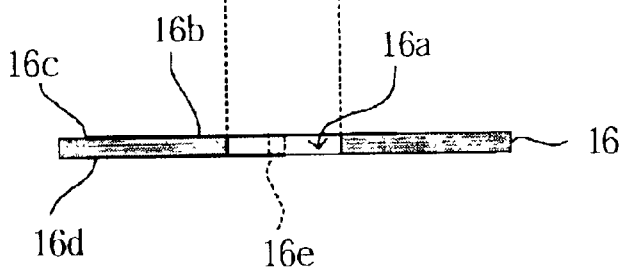

The second substrate 16 is formed from an insulation substrate, and includes a penetration (insertion) hole 16*a* in the center thereof, as shown in FIGS. 3A and 3B. This penetration (insertion) hole 16*a* has such a diameter that can contain the cylindrical core part 13 therein.

A sheet coil 16*b* is printed and wired on both surfaces of the second substrate 16, in such a manner that it spirally coils around the penetration hole 16*a*. In more particular, the sheet coil 16*b* extends from a lead terminal 16*c* formed in one surface of the second substrate 16, and spirally coils around the penetration hole 16*a*. Then, the sheet coil 16*b* proceeds to the other surface of the second substrate 16 through a via hole 16*e*, spirally coils around the penetration (insertion) holes 16*a* in the surface, and reaches a lead terminate 16*d* formed in a portion of the other surface of the second substrate 16.

Figure 4A:
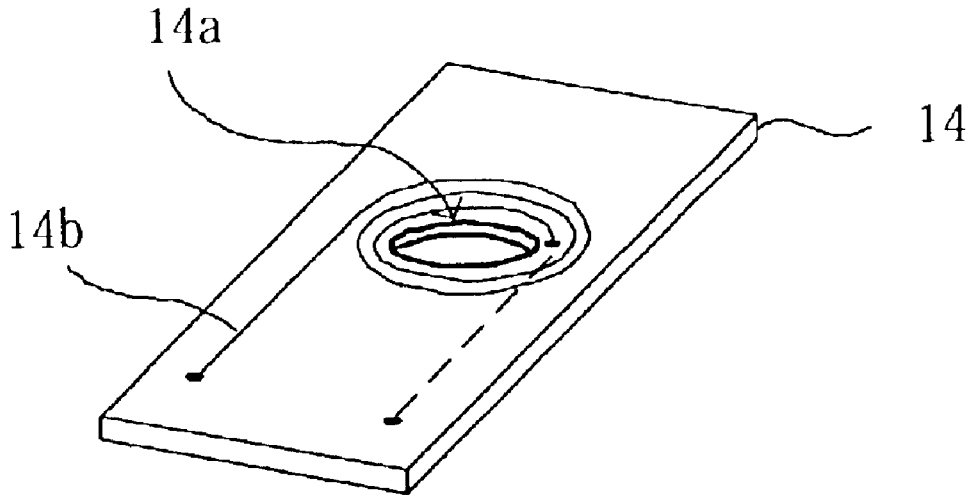
FIGS. 4A and 4B are a diagram showing the structure of a first substrate shown in FIG. 1.
Figure 4B:
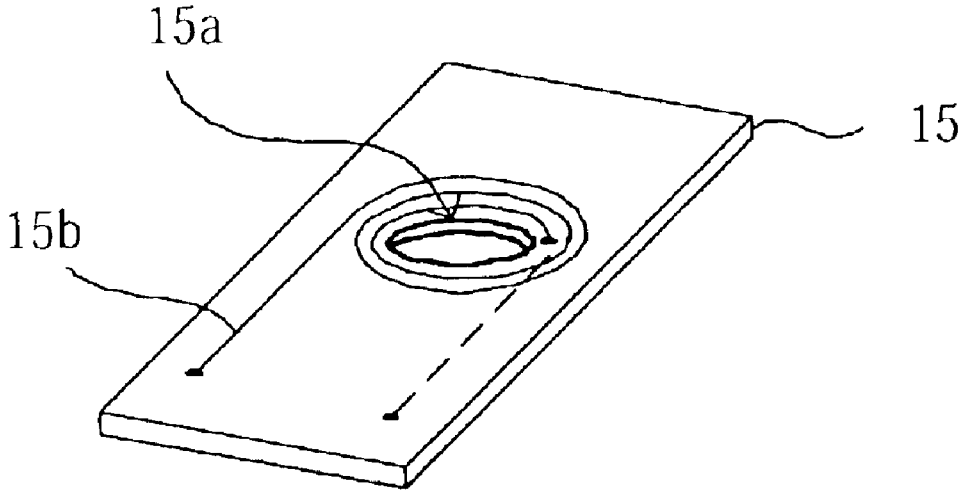

Likewise the second substrate 16, the first substrates 14 and 15 include penetration (insertion) holes 14*a* and 15*a* in the center thereof, respectively, and have sheet coils 14*b* and 15*b* printed thereon, as shown in FIGS. 4A and 4B.

The penetration (insertion) holes 14*a* and 15*a* of the first substrates 14 and 15 are formed in such a manner that the cylindrical core legs 11*a* and 12*a* of the E-type core parts 11 and 12 can penetrate through the holes.

The insulating sheet 17 shown in FIG. 1 is formed from a sheet of paper in a thickness of 50 $\mu$m, mica, polyester, polypropylene, polytrafluoethylene, polyimide, etc.

The insulating sheet 17 is prepared for insulating between the sheet coil 16*b* (serving as a secondary coil) on the second substrate 16 shown in FIGS. 3A and 3B and the sheet coils 14*b* and 15*b* (serving as primary coils) on the first substrates 14 and 15 shown in FIG. 4. In addition, the insulating sheet 17 is prepared for ensuring the creepage distance between the first and second coils.

Explanations will now be made to an assembly method of the transformer 1.

Figure 5:
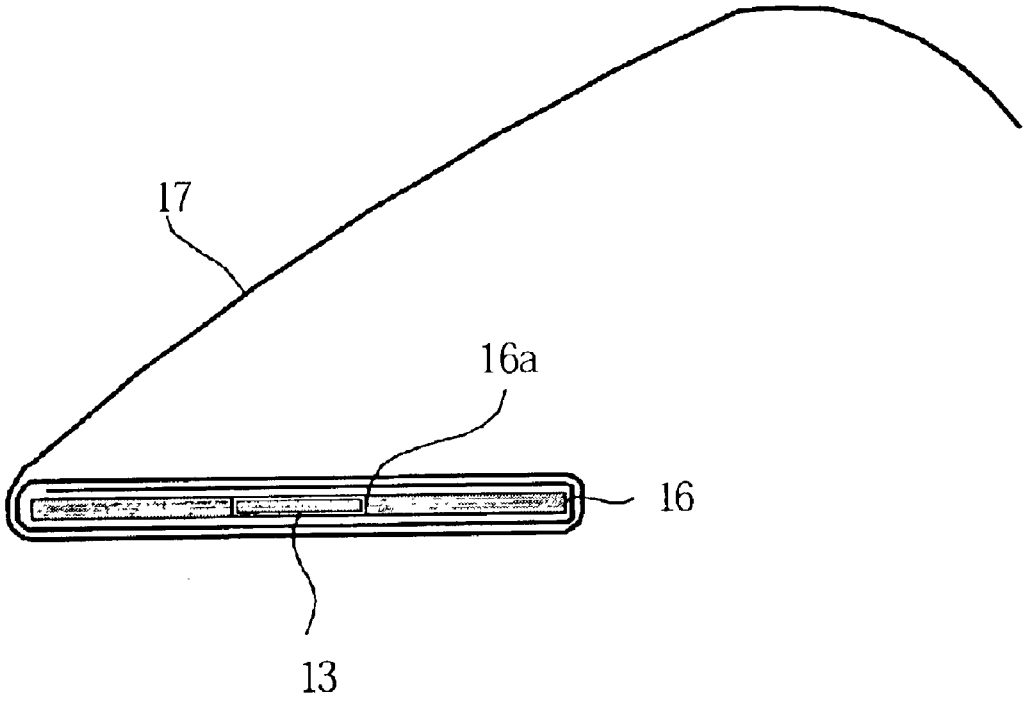
FIG. 5 is an explanatory diagram showing the partial structure of the transformer of FIG. 1, wherein a cylindrical core part is contained in the second substrate.

As illustrated in FIG. 5, the cylindrical core part 13 is contained in the penetration (insertion) hole 16*a* of the second substrate 16. The second substrate 16 and the cylindrical core party 13 are wrapped (covered) with the insulating sheet 17. In this case, the second substrate 16 and the cylindrical core part 13 are wrapped three times with the insulating sheet 17, so that IEC (International Electrotechnical Commission) 950 can be satisfied.

Figure 6:
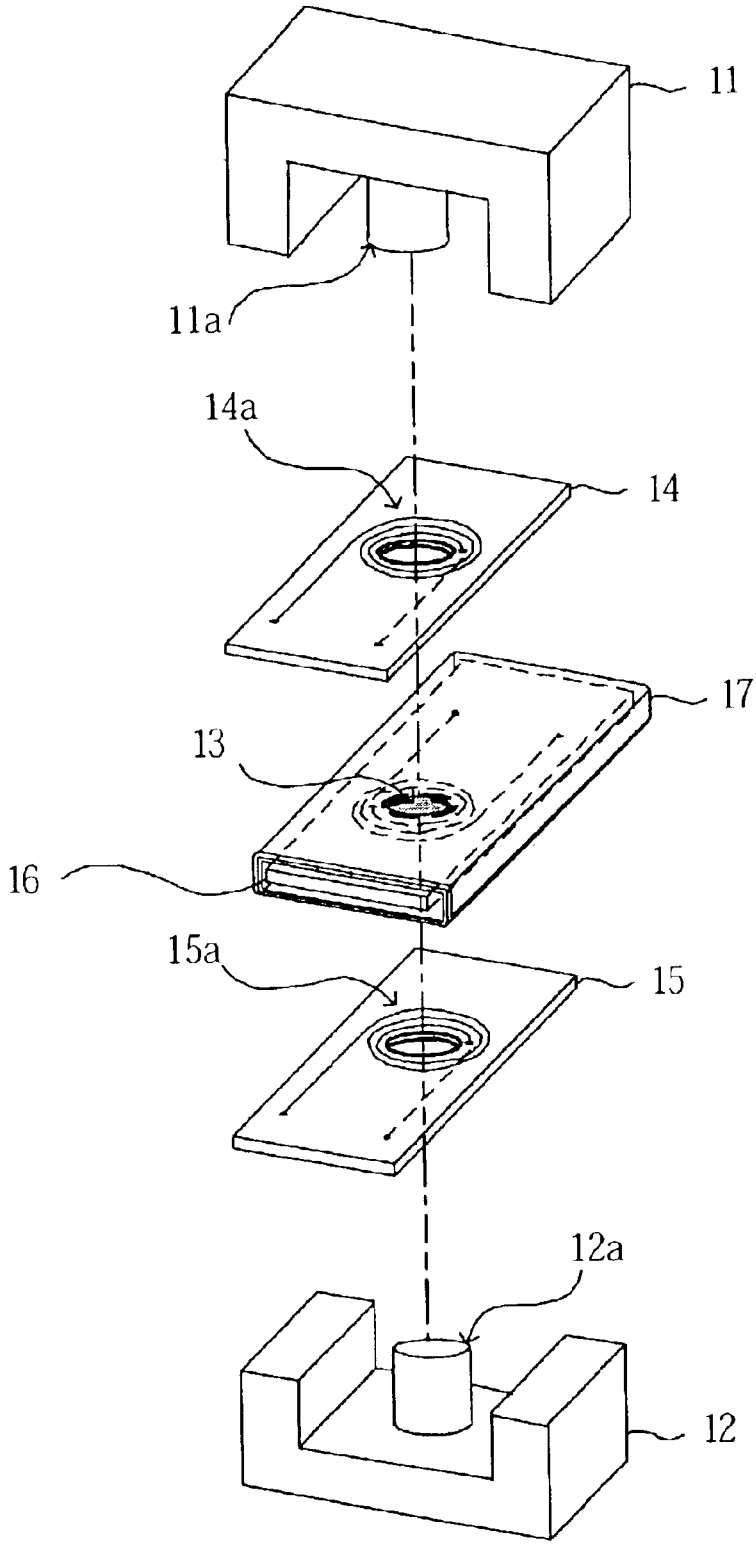
FIG. 6 is an assembly diagram showing how to assemble the transformer of FIG. 1.

As shown in FIG. 6, the second substrate 16 and the cylindrical core part 13, which are wrapped with the insulating sheet 17, are arranged between the first substrates 14 and 15.

The second substrate 16 and the cylindrical core part 13 are sandwiched by facing ends of the cylindrical core legs 11*a* and 12*a* of the E-type core parts 11 and 12 through the insulating sheet 17, so as to be fixed therebetween.

In thus formed transformer 1, the sheet coils 14*b* and 15*b* on the respective first substrates 14 and 15 serve as primary coils, while the sheet coil 16*b* formed on the second substrate 16 serves as a secondary coil.

Upon application of an alternating voltage to the primary sheet coils 14*b* and 15*b*, a magnetic flux is generated by a current flowing to the sheet coils 14*b* and 15*b* while passing through a magnetic path formed by the core 10, which comprises the E-type core parts 11 and 12 and the cylindrical core part 13. At this time, the generated magnetic flux penetrates through the center of the secondary coil 16*b,* and the voltage which has been transformed is output from the sheet coil 16*b* as a result of mutual induction.

As explained above, according to this embodiment, the second substrate 1 and the cylindrical core part 13 are wrapped three time with the insulating sheet 17. Thus, it is easy to ensure the insulation withstanding voltage and the creepage distance, and so that the conditions of IEC 950 can be fulfilled.

The core legs 11*a* and 12*a* penetrate through the penetration (insertion) holes 14*a* and 15*a* of the respective first substrates 14 and 15. Hence, the first substrates 14 and 15 can not come off from the transformer 1 as a result of any external factor, such as a shock, etc. Since the second substrate 16 is sandwiched between the magnetic legs 11*a* and 12*a,* and fixed therebetween, so that the second substrate 16 can not come off from the transformer 1. Thus, the coils can be prevented from coming off from the transformer 1.

Since the transformer 1 can easily be manufactured, the mass-production of the transformer 1 can easily be realized, and hence achieving a cost reduction.

The present invention is not limited to the above embodiment. For example, each of the first substrates 14 and 15 and the second substrate 16 may be a multi-layer substrate, one surface of which is multi-layered.

Instead of wrapping the second substrate 16 and the cylindrical core part 13 with the insulating sheet 17, the second substrate 16 and the cylindrical core part 13 can be put in a bag which is formed with a three layered insulating sheet, so as to be insulated.

The sheet coils 14*b* and 15*b* may be used as a secondary coil instead of a primary coil, which the sheet coils 16*b* may be used as a primary coil instead of a secondary coil.

Second Embodiment

Figure 7:
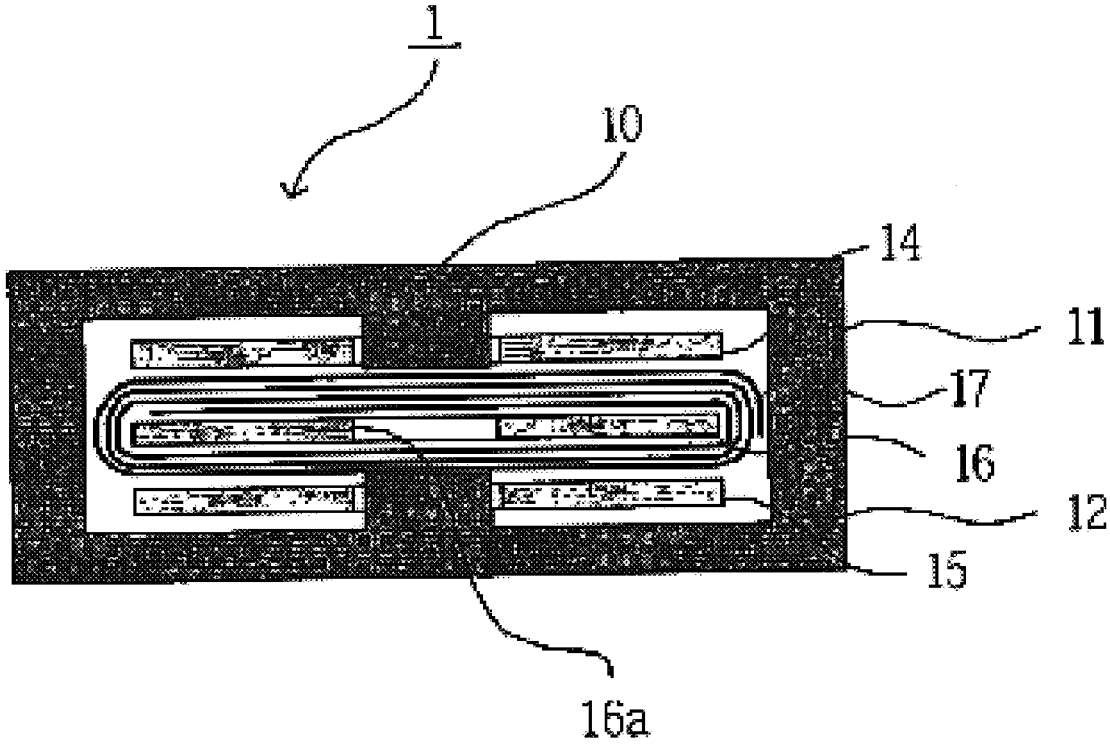
FIG. 7 is a cross sectional view showing the structure of a transformer according to the second embodiment of the present invention.

In the first embodiment, the cylindrical core part 13 is arranged between the core legs 11 and 12*a*. However, in the case where the magnetic resistance of the core 10 is set high, the cylindrical core part 13 may not be arranged between the core legs 11*a* and 12*a,* as illustrated in FIG. 7.

In this case, a part of the magnetic path is formed by a gap between the core legs 11*a* and 12*a* of the E-type core parts 11 and 12.

According to such a structure, magnetic saturation is unlikely to occur in the transformer 1 of the second embodiment as compared to the transformer 1 of the first embodiment.

It is not necessary that the penetration (insertion) hole 16*a* be arranged in the second substrate 16, because the cylindrical core part 13 is not used. In this case, a portion of the substrates between the core legs 11*a* and 12*a* serves as a gap. Further, a spacer which is formed of a resin, etc. may be arranged in the penetration (insertion) hole 16*a* (the gap).

Third Embodiment

The third embodiment of a switching source (power supply) circuit, which includes the transformer 1 according to the first or second embodiment mounted on a circuit substrate thereof, will now be described.

Figure 8:
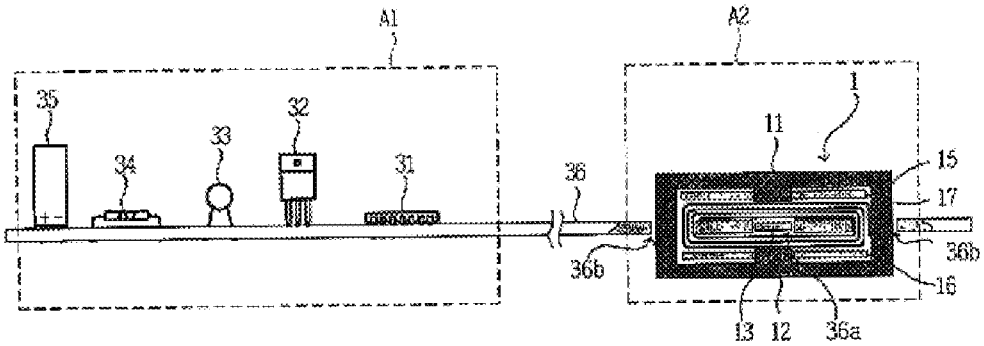
FIG. 8 is a cross sectional view showing the structure of a transformer according to the third embodiment of the present invention.

The switching source circuit according to the third embodiment of the present invention includes a circuit substrate 36, as shown in FIG. 8. A switching circuit, a rectification circuit, and a smoothing circuit, etc. are arranged in a circuit arrangement section A1 on the circuit substrate 36. The transformer 1 is arranged in a transformer arrangement section A2, which is a predetermined distance away from the circuit arrangement section A1. The circuit arrangement section A1 and the transformer arrangement section A2 form a DC-DC converter as a whole.

The switching circuit formed in the circuit arrangement section A1 includes an IC (Integrated Circuit) 31 for switching, a FET (Field Effect Transistor) 32, an oscillator and the like, and generates an alternating current from a direct-current source. The alternating current generated by this switching circuit is supplied to the sheet coils 14*b* and 15*b* on the respective first substrates 14 and 15 of the transformer 1, through the wiring and jumper line which are printed and wired on the substrate 36.

A current, which is generated at the secondary coil 16*b* as a result of mutual induction among the primary coils 14*b,* 15*b* and the secondary coil 16*b* in the transformer 1, is rectified, smoothed and then supplied to the load. This rectification and smoothing are done by the rectification circuit and smoothing circuit including electronic units, such as a capacitor 33, a resistor 34, and an electrolytic capacitor which are arranged in the circuit arrangement section A1, through the wiring printed and wired on the substrate 36.

The circuit substrate 36 includes a penetration (insertion) hole for containing the cylindrical core part 13. Two penetration (insertion) holes 36*b,* through which the core legs of the E-type core parts 11 and 12 penetrate, are formed in two positions of the substrate 36.

The secondary coil 16*b* is spirally printed and wired around the penetration hole 36*a,* and connected to the circuit arrangement section A1 through the wiring of the substrate 36.

Likewise the first and second embodiments, the cylindrical core part 13 is arranged in the penetration hole 36*a,* and is wrapped with the insulating sheet 17 together with the secondary coil 16*b*. The first substrates 14 and 15 are laminated on the insulating sheet 17.

The cylindrical core part 13 and the substrate 36 are sandwiched between the core legs 11*a* and 12*a* of the E-type core parts 11 and 12, through the insulating sheet 17.

According to such a structure, the transformer 1 can be incorporated directly onto the circuit substrate 36. Thus, the switching source circuit can be made small.

The present invention is not limited to the above embodiments. For example, the switching source circuit may be used just by itself, or may be used in combination with any other circuit substrate.

Figure 9:
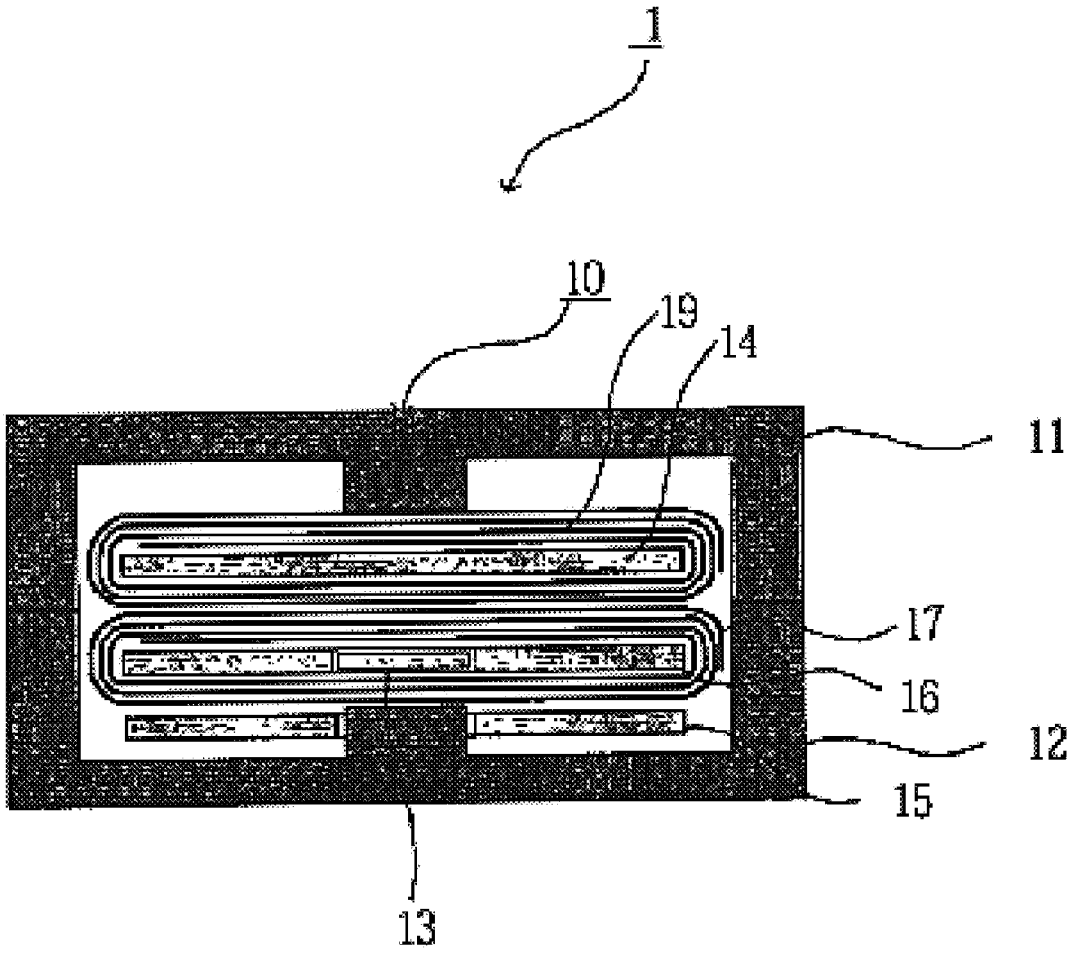
FIG. 9 is a cross sectional view showing the structure of a transformer according to the modified example of the present invention.
Figure 10:
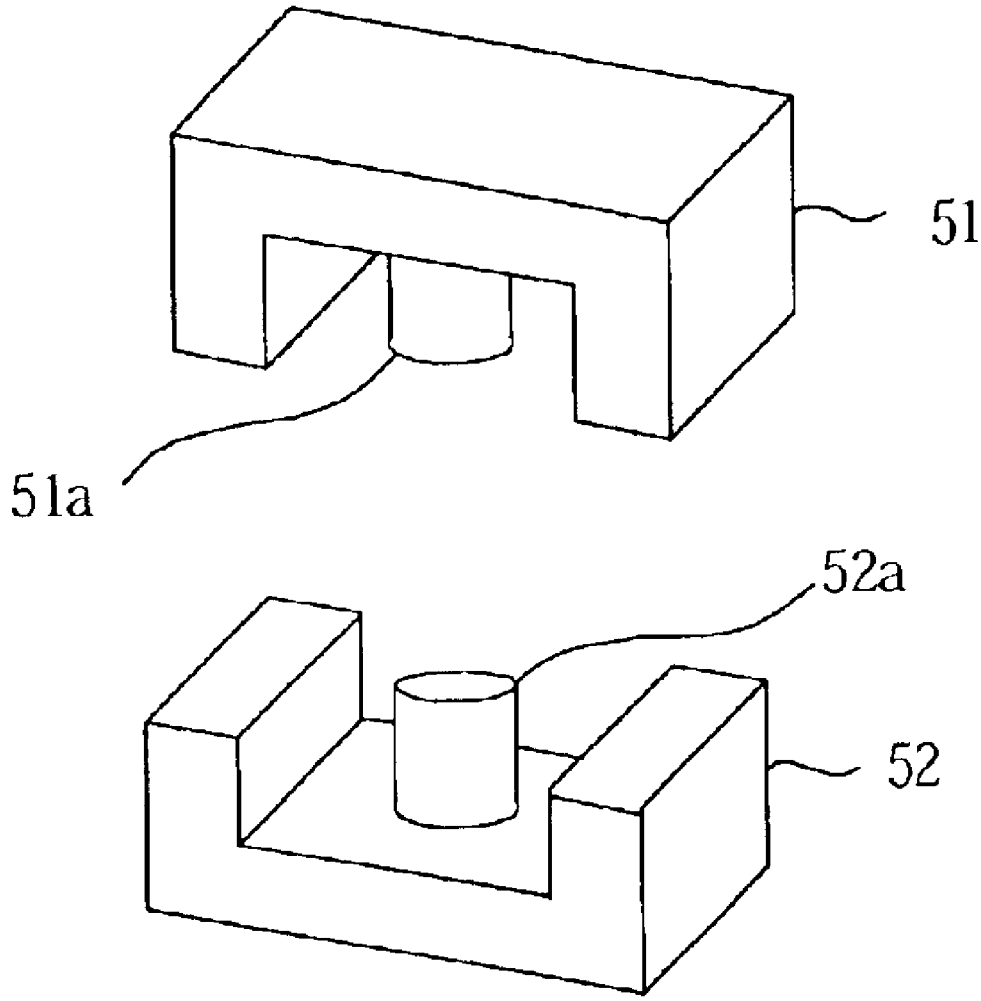
FIG. 10 is a perspective diagram showing a core employed in a conventional thin-type transformer.
Figure 11:
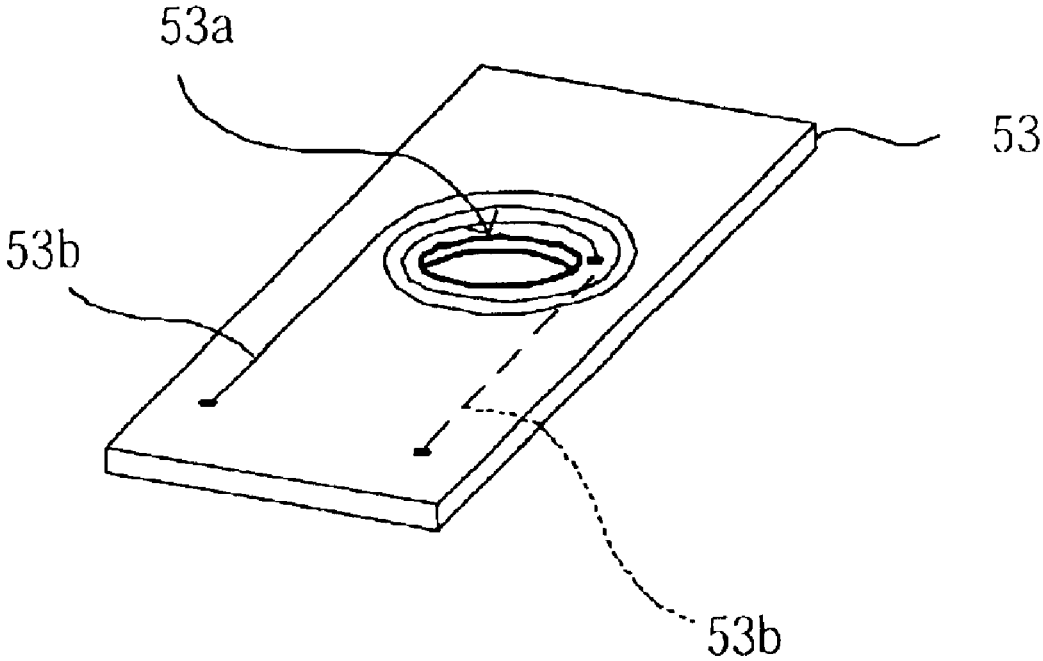
FIG. 11 is a perspective diagram showing a printed wiring board used in the transformer of FIG. 10.

Not only the second substrate 16, but also the first substrate 14 and/or 15 may be wrapped with an insulating sheet as shown in FIG. 9.

Various embodiments and changes may be made thereonto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application is based on Japanese Patent Application No. 2001-143924 filed on May 14, 2001 and including specification, claims, drawings and summary. The disclosure of the above Japanese Patent Application is incorporated herein by reference in its entirety.

What is claimed is:

1. A transformer comprising:

a first substrate which includes a first winding;

a second substrate which includes a second winding and an opening in center of the second winding;

an insulating material which covers said first substrate and insulates between said first winding and said second winding; and a core which has two ends holding said first substrate covered with said insulating material through said insulating material therebetween, and which forms a part of the magnetic path passing through said first winding and second winding, wherein;

said first substrate includes an opening in a center portion of said first winding and a core member arranged in said opening of said first substrate;

said insulating material covers said first substrate including said core member; and said core is so formed that said core member of said first substrate is sandwiched between the two ends through said insulating material.

2. The transformer according to claim 1:

wherein said core and said core member are to form a part of the magnetic path which passes through said first winding and said second winding.

3. The transformer according to claim 1, wherein:

said core includes a first core leg and a second core leg respectively forming a part of the magnetic path;

said first substrate is sandwiched between said first and second core legs through said insulating material; and one of said first and second core legs penetrates through the opening formed in said second substrate.

4. The transformer according to claim 3, wherein:

each of said first winding and said second winding is formed from a sheet coil and said first and second windings are stacked up one after another;

said insulating material comprises a sheet-like insulating material which covers over said first winding; and said first core leg and second core leg of said core are so arranged that center of said first winding covered with said insulating material is sandwiched therebetween.

5. The transformer according to claim 4, wherein:

said second winding comprises two sheet coils between which said first winding is arranged; and said transformer further comprises a second insulating material which covers at least one of said sheet coils constituting said second winding.

6. A transformer comprising:

a first substrate which includes a first winding;

a second substrate which includes a second winding and an opening centered in the second winding;

an insulating material which covers said first substrate and insulates between said first winding and said second winding; and a core which has two ends holding said first substrate covered with said insulating material through said insulating material therebetween, and which forms a part of the magnetic path passing through said first winding and said second winding, wherein:

said first substrate includes an opening in a center portion of said first winding;

said core is so formed that the opening of said first substrate is sandwiched between the two ends through said insulating material; and a space, comprising the opening of said first substrate, which is for realizing high magnetic resistance of said core, is formed between the two ends, in a state where said two ends sandwich said first substrate.

7. The transformer according to claim 6, wherein:

said opening forms a gap of the magnetic path passing through the first winding and said second winding.

8. The transformer according to claim 6, wherein:

said second substrate comprises two substrates, respectively including said second winding, where said first winding is placed in between the two substrates, said second winding which is sandwiched by said two substrates, functions as a secondary coil of said transformer.

9. A transformer comprising:

a first sheet coil;

a second sheet coil which is stacked on said first sheet coil and has mutual induction with said first sheet coil;

an insulating material which so covers over said first sheet coil as to insulate first and second sheet coils from each other and ensure a creepage distance between said first and second sheet coils; and a core comprising two ends that sandwich said insulating material that covers said first sheet coil, and which is to form a part of the magnetic path through said first and second sheet coil; wherein a core member is arranged in a center portion of said first sheet coil; and said core member and said core are to form a magnetic path passing through center portions of said first and second sheet coils.

10. The transformer according to claim 9, wherein:

said core is formed of ferrite.

11. A transformer comprising:

a first sheet coil;

a second sheet coil which is stacked on said first sheet coil and has mutual induction with said first sheet coil;

an insulating material which so covers over said first sheet coil as to insulate first and second sheet coils from each other and ensure a creepage distance between said first and second sheet coils; and a core which comprises two ends that sandwich said insulating material that covers said first sheet coil, and forms a part of the magnetic path through said first and second sheet coil, wherein:

the center portion of said first sheet coil has an opening; and a space comprises said opening serves as a gap of a part of the magnetic path formed by said core, is formed between the two ends, in a state where the two ends sandwich said insulating material.

12. The transformer according to claim 11, wherein:

said second sheet coil comprises a first coil and a second coil, where said first sheet coil is placed in between thereof;

said second sheet coil functions as a primary coil of said transformer; and said first sheet coil, which is sandwiched by said first coil and said second coil, functions as a secondary coil of said transformer.

* * * * *